US008109397B2

(12) United States Patent
Deyerl et al.

(10) Patent No.: US 8,109,397 B2
(45) Date of Patent: Feb. 7, 2012

(54) PLASTIC CONTAINER WITH CURVED BASE SECTION

(75) Inventors: Heinrich Deyerl, Teunz (DE); Gerhard Schuster, Pfakofen (DE); Bastian Tissmer, Regensburg (DE)

(73) Assignee: Krones AG (DE)

( * ) Notice: Subject to any disclaimer, the term of this patent is extended or adjusted under 35 U.S.C. 154(b) by 532 days.

(21) Appl. No.: 12/195,709

(22) Filed: Aug. 21, 2008

(65) Prior Publication Data

US 2009/0050597 A1 Feb. 26, 2009

(30) Foreign Application Priority Data

Aug. 21, 2007 (DE) ..... 20 2007 011 803 U

(51) Int. Cl.
*B65D 1/02* (2006.01)
*B65D 1/42* (2006.01)

(52) U.S. Cl. ..... 215/375; 215/373; 220/608

(58) Field of Classification Search ..... 215/373, 215/370, 375–377; 220/606, 608, 609
See application file for complete search history.

(56) References Cited

U.S. PATENT DOCUMENTS

| | | | | |
|---|---|---|---|---|
| 3,935,955 | A | 2/1976 | Das | 215/1 |
| 5,603,423 | A * | 2/1997 | Lynn et al. | 215/375 |
| 5,989,661 | A * | 11/1999 | Krishnakumar et al. | 428/35.7 |
| D547,186 | S * | 7/2007 | Boukobza | D9/516 |
| 7,416,088 | B2 | 8/2008 | Boukobza | 215/373 |
| 7,461,756 | B2 * | 12/2008 | Pedmo et al. | 215/375 |

FOREIGN PATENT DOCUMENTS

| | | |
|---|---|---|
| FR | 2 856 380 | 12/2004 |
| WO | WO 98/28193 | 7/1998 |

* cited by examiner

*Primary Examiner* — Sue Weaver
(74) *Attorney, Agent, or Firm* — Hayes Soloway P.C.

(57) ABSTRACT

A container made from plastic for holding beverages. The container comprises a mouth, a wall section which adjoins the mouth in a longitudinal direction (L) of the container, and a base section which is designed as a standing face. The wall section merges into the base section. The container is formed in one piece. The base section has an injection point located in the interior in a radial direction (R) with respect to the longitudinal direction (L), and a central region which surrounds this injection point, and also a transition section which extends from the central region to the wall section. The transition section has a curvature with a finite radius of curvature in at least one and preferably in every radial direction (R) of the container in every geometric sub-section.

9 Claims, 3 Drawing Sheets

Fig. 1
(PRIOR ART)
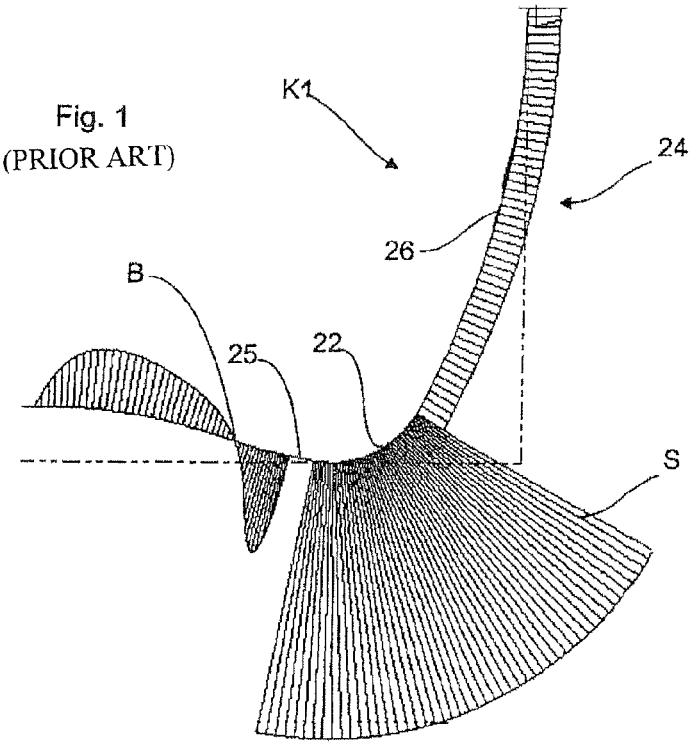
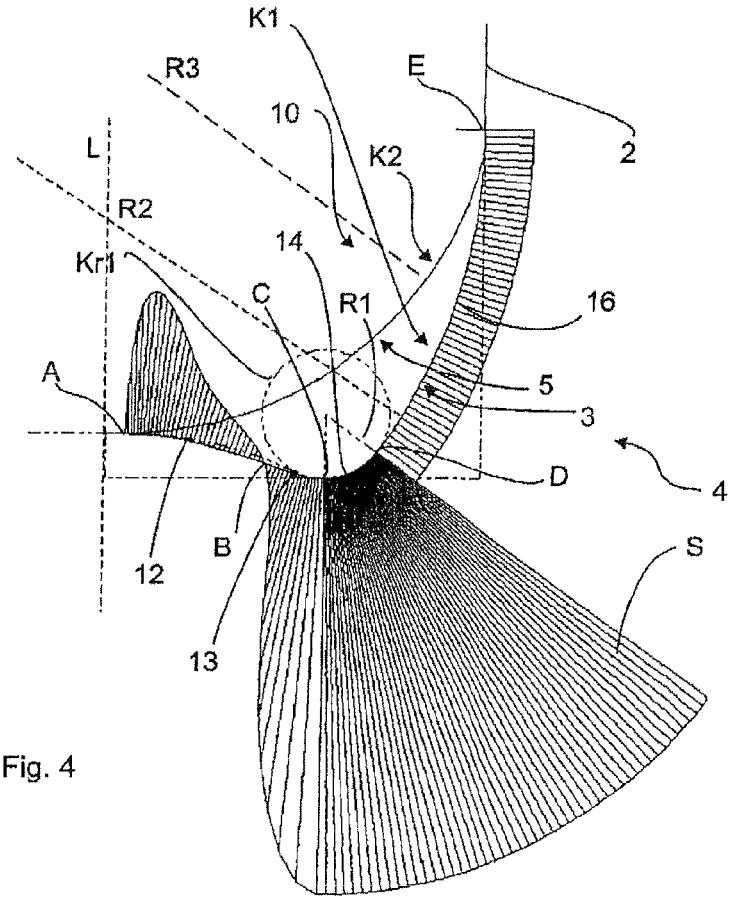
Fig. 4

Fig. 2a
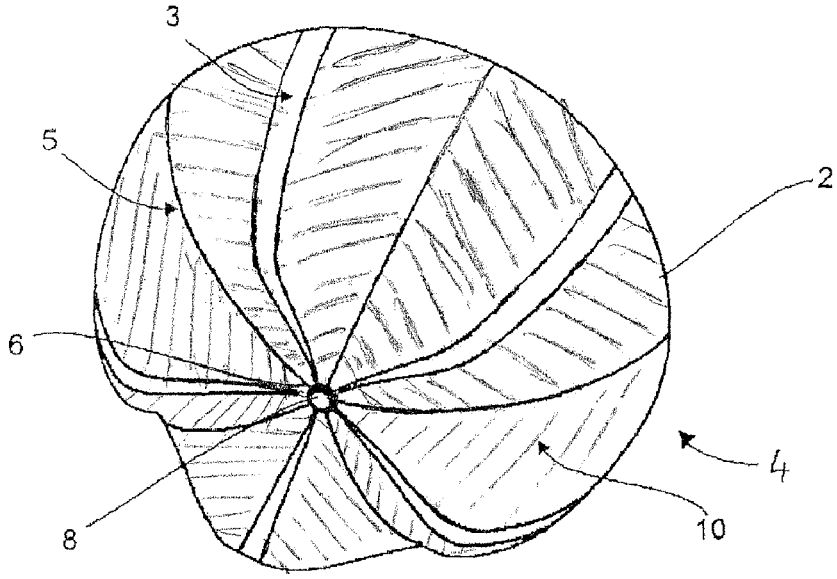
Fig. 2b
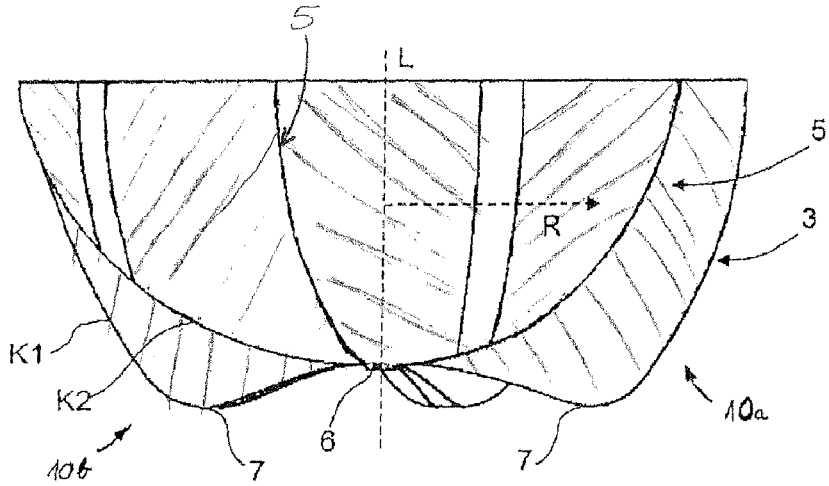
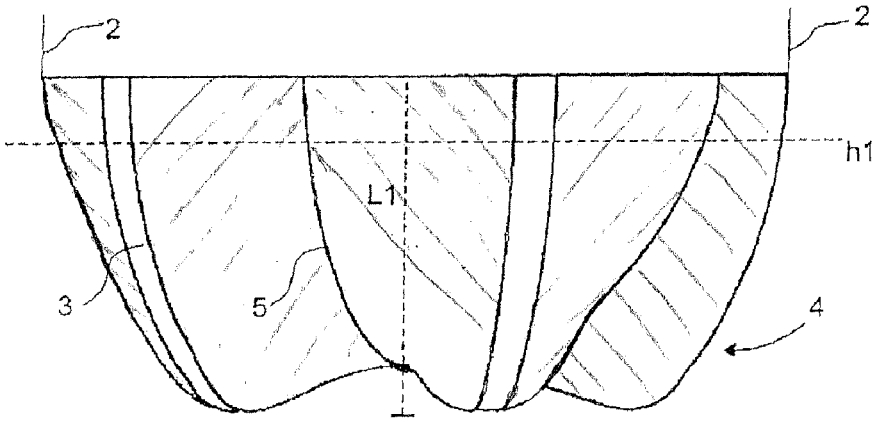
Fig. 2c

PLASTIC CONTAINER WITH CURVED BASE SECTION

BACKGROUND OF THE INVENTION

The present invention relates to a container made from plastic for holding beverages. Such containers have long been known from the prior art and are increasingly superseding glass bottles as beverage containers. The advantage of these plastic containers lies in particular in the reduced weight, the optimal handling in terms of the design, and in part in the ability to be reused a number of times. Various bottles in a wide range of sizes both for small filling quantities in the region of 200 ml to large filling quantities of 5 l are known from the prior art. These containers have a wide range of shapes. During the production process, the preforms are blown out or expanded for example by means of air pressure to form the plastic containers. For this purpose, the preforms are usually inserted into a mould and expanded against this mould. In order to save costs, attempts are being made to produce the plastic containers with less and less outlay on materials. However, this means on the other hand that increasingly high demands are being placed on the stability of the bottles in relation to the quantity of material used.

The object of the present invention is therefore to provide a container which has a high degree of shape stability. In addition, a container is to be provided which is easier and less expensive to produce in the context of the expanding process. This is achieved according to the invention by the container according to claim 1. Advantageous embodiments and further developments form the subject matter of the dependent claims.

SUMMARY OF THE INVENTION

A container made from plastic according to the invention for holding beverages comprises a mouth, a wall section which adjoins the mouth in the longitudinal direction of the container, and a base section which is designed as a standing face, wherein the wall section merges into the base section and the container is formed in one piece.

According to the invention, the base section has an injection point located in the interior in a radial direction with respect to the longitudinal direction, and a central region which surrounds this injection point, and also a transition section which extends from this central region to the wall section, wherein this transition section has a curvature with a finite radius of curvature in at least one, preferably in several and particularly preferably in every radial direction of the container in every geometric sub-section. The radial directions here are to be understood with reference to a longitudinal direction of the container.

In other words, the base section has, apart from the central region, no rectilinear or non-curved sections in the radial direction. Although different curvatures, i.e. curvatures in different directions, may merge into one another and may thus lead to geometric points of inflection at which, mathematically speaking, there is no curvature, nevertheless there are no extensive rectilinear sections. The advantage of such an embodiment lies in a greater stability and a greater ease of moulding. By avoiding rectilinear sections, edges or points which mathematically speaking cannot be differentiated are also avoided and thus the shape stability of the particularly sensitive base section is increased. Preferably, the mouth has an external thread.

To put it another way, the outer face or the inner face of the transition section may be designed as a curve in a projection in at least one, preferably in several and particularly preferably in every direction perpendicular to the longitudinal direction, wherein the second mathematical derivative of a mathematical function representing these curves has the value 0 in no part of the curve outside the central region. In other words, this curve is always curved, although it is conceivable that this curve has individual points of inflection at which for example a positive curvature changes to a negative curvature. Accordingly, a mathematical function describing this curve would possibly have isolated zero points in its second derivative. Points are therefore not regarded as sections, but rather sections are lengths in the mathematical sense.

In one advantageous embodiment, the base section is designed with point symmetry with respect to the injection point. Furthermore, the central region, with respect to the geometric centre point of the base section, has a radius of less than 15 mm, preferably less than 10 mm and particularly preferably less than 5 mm. In this central region, a rectilinear course of the base section is possible. In a further advantageous embodiment, the cross section of the container widens starting from the mouth towards the wall section.

In a further advantageous embodiment, the curve in at least one radial direction outside the central region has precisely two points at which the second mathematical derivative of a mathematical function representing this curve has the value 0. As seen in the radial direction of the container, therefore, precisely two points of inflection are provided. More specifically, the base section has several points of inflection, which in this embodiment are at a constant distance from the geometric centre point of the bottle. In this case, all the points of inflection are arranged substantially on a circular line around the geometric centre point. Substantially here means that the points of inflection with respect to the radius of the container are shifted by no more than 10%, preferably by no more than 5%, away from said circular line.

In this embodiment, therefore, advantageously the two aforementioned points of inflection lie symmetrically opposite one another with respect to the longitudinal axis of the container.

Preferably, the curve in another radial direction outside the central region has the value 0 at no point.

In a further advantageous embodiment, the transition section directly adjoins the central region. It is therefore possible that a partially rectilinear central region is provided, which is directly adjoined by the curved transition region of the container.

In a further advantageous embodiment, the transition section has a first curved region with a substantially constant first radius of curvature. This means that the first curved region is curved in the shape of a segment of a circle. In a further advantageous embodiment, the first curved region within the transition section is adjoined by a second curved region, wherein this second curved region likewise has a constant second radius of curvature. With particular advantage, this second curved region directly adjoins the first curved region.

However, it would also be possible to configure the second curved region not in the form of a circular line but rather in the form of a so-called polyspline, i.e. a curve which is generated by a polynomial of the $n^{th}$ degree. In principle, it would also be possible to form the first curved region by a polyspline, but preferably the first curved region is of circular shape. In a further advantageous embodiment, the first curved region and the second curved region are curved in the same direction of curvature. With particular advantage, the radius of curvature of the second curved region is greater than the radius of curvature of the first curved region. As a result, as seen from the inside towards the outside, a region of more pronounced curvature merges into a region of less pronounced curvature.

With particular advantage, the base section is a free-formed base section. This means that the mould which produces this base section is produced not by cutting out using a rotary element but rather that free mould surfaces have been determined via CAD sketches for example, and these in turn form the basis for a mould inside which the container is expanded.

Further advantages and embodiments emerge from the appended drawings.

BRIEF DESCRIPTION OF THE DRAWINGS

In the drawings:

FIG. 1 shows a projection of a base section of a container according to the prior art;

FIG. 2*a* shows a perspective view of a base section according to the invention;

FIG. 2*b* shows a side view of the base section of a container according to the invention;

FIG. 2*c* shows a base section and part of a wall section of a container according to the invention;

FIG. 4 shows a projection of two lines of curvature for a container according to the invention.

DETAILED DESCRIPTION

Figure 3:
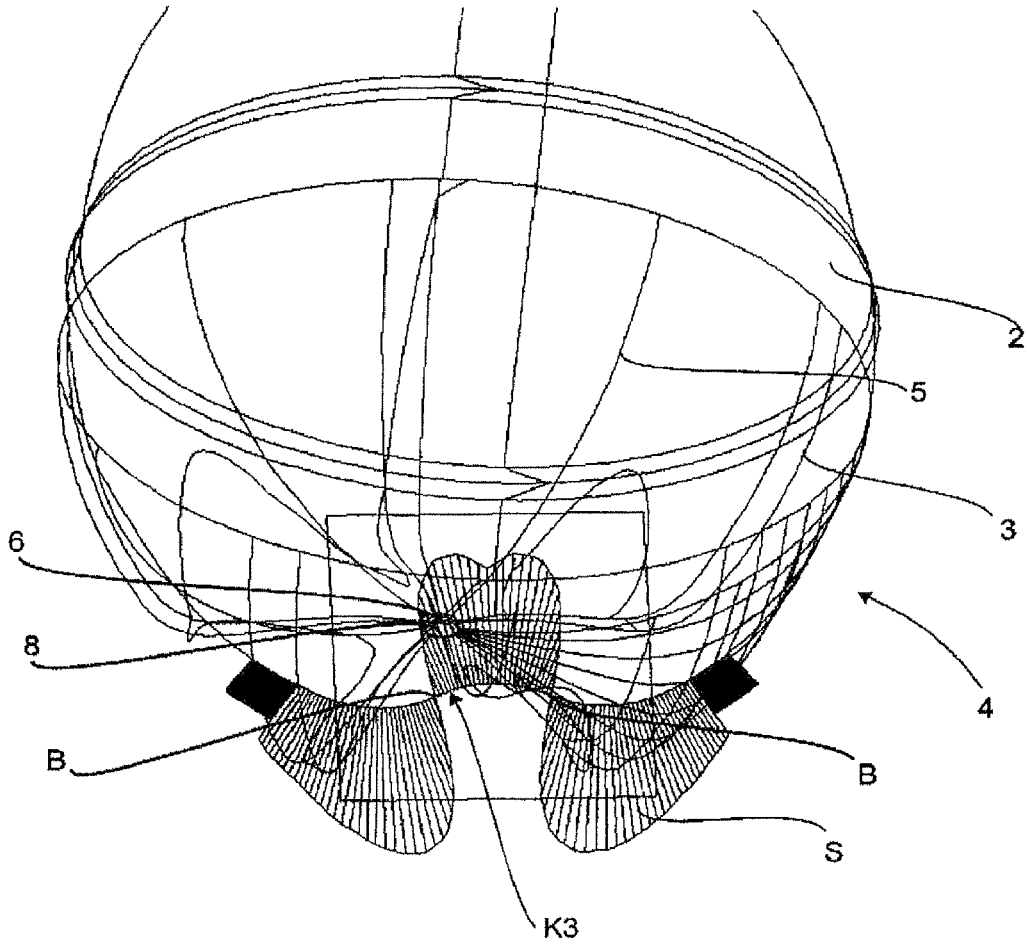
FIG. 3 shows a line drawing of a base section according to the invention to illustrate the curvature ratios.

FIG. 1 shows a partial illustration of a (projection) curve K1 of a base section 24 of a container (not shown in its entirety) according to the prior art. Here, the lines S protruding in each case radially from the curve K1 are an indication of the curvature of this curve. It can be seen that the curve K1 has a region 25 in which there is no curvature, i.e. in which the curve is rectilinear. This rectilinear section may lead to increased stresses in the corresponding region and also to fractures. Reference B here denotes a point of inflection at which the curvature of the curve K1 changes. Reference 22 denotes a first curved region and reference 26 denotes a second curved region.

FIG. 2*a* shows a perspective view of a base section according to the invention. The base section 4 has in its centre an injection point 8 and a central region 6 surrounding this injection point 8. Here, both the injection point 8 and the central region 6 are of substantially circular shape. Within this central region 6, both curved but also rectilinear courses of the base section are possible. The central region 6 is adjoined by a transition section denoted 10 in its entirety, which transition section finally merges into the wall section 2 (not shown in its entirety). The base section 4 comprises mound-like curved regions or curved outer ridges 3, which ultimately also form the standing faces for the container. Located between these mound-like regions 3 are troughs or depressions 5 in each case. The number of these depressions 5 and of the mound-like curved regions may vary.

FIG. 2*b* shows a sectional view of the base section 4 shown in FIG. 2*a*. This sectional view shows both an outer contour of the base section 4 in a mound-like curved region 3 and also the relevant outer contour in the respective depressions 5. In both regions, however, the respective transition section 10*a*, 10*b* is curved, i.e. has no rectilinear section. Furthermore, there are preferably no curvatures in the regions which lie between the depression 5 and the mound-like curved region 3. It is thus possible, regardless of the choice of radial directions R extending in the circumferential direction around the longitudinal direction L, to project a curve K which has no rectilinear section outside the central region 6. Reference 10 denotes the transition section in its entirety, and references 3*a* and 5*a* denote a portion of a mound-like curved region and a portion of a depression, respectively, lying entirely within the transition section as seen in a certain direction. Reference 7 denotes a protrusion which is formed by a lower section of the mound-like curved region 3 and which furthermore serves as a standing face.

FIG. 2*c* shows a side view of a base section 4 according to the invention with an adjoining wall section 2. Here, too, both the central region of the depressions 5 and also the central region of the mound-like curved region 3 are marked by lines. Preferably, the base section also has no rectilinear section in a circumferential direction running around the longitudinal axis L along at least one height line h1. Preferably, such a rectilinear section is not present at any height line hx along the entire longitudinal extent L1 of the base section 4.

FIG. 3 shows a perspective line diagram to illustrate the curvature ratios. The lines S here are once again an indication of the curvature of the respective section in question. It can be seen that the curve K3 singled out here likewise has no rectilinear sections but rather only points of inflection B at which the curvature changes.

In such projections of the base section which do not run through the injection point 8 or through the central region 6, there is preferably no rectilinear course anywhere in the entire region of the base section 4, as can be seen in FIG. 3. This procedure also leads to a particularly favourable stability of the container. Reference K3 denotes such a curve. This curve K3 has two points of inflection B at which the direction of curvature changes.

FIG. 4 shows a projection of a geometric curve K1 in the region of a mound-like curved region 3 and also a geometric curve K2 in the region of a depression 5. Located to the left of the marked point A is the central region 6, which may also be rectilinear (not shown). Between the point A and the point B, the curve K1 has a downward curvature which is also referred to below as a negative curvature.

At the point B, the negative curvature changes into a positive curvature, so that the point B represents a point of inflection in the mathematical sense. The curvature changes constantly in the lower section 12 between the point A and the point B. For instance, starting from the point A, it firstly increases its value until it reaches a maximum value and then decreases its value again until it reaches the point B.

This course of the curvature can be described by a polynomial of the $n^{th}$ degree. Between the point B and the point C, this is adjoined by a further lower section 13 in which the curvature is positive and rises to a maximum value at the point C. Between the point C and the point D, this is adjoined by a lower section 14 in which the curvature is constant or has a constant radius of curvature R1. In other words, the curve K1 here lies on a circular line of a circle Kr1. At the point D, the radius of curvature suddenly increases, so that a lower section with a constant radius of curvature R2 exists between the point D and the point E.

The curve K2 describes the course of the curvature in the region of a depression 5. Preferably, the curvature here is described by a constant radius of curvature R3. The curves K2 and K1 merge into one another at the point E, and this point E is adjoined by the substantially circular wall section 2. Preferably, as shown in FIG. 4, the radius of curvature R1 is smaller than the radius of curvature R2, and the radius of curvature R3 is greater than the radius of curvature R1, but smaller than the radius of curvature R2.

The two curves K1 and K2 also merge into one another at the point A. It is pointed out that the further curves, which in the circumferential direction of the base section lie between the curve K2 and the curve K1, likewise also merge into one another at the points corresponding to points A and E in the circumferential direction of the base section 4.

All of the features disclosed in the application documents are claimed as being essential to the invention in so far as they are novel individually or in combination with respect to the prior art.

The invention claimed is:

1. A container, comprising:

a mouth;

a wall section which adjoins the mouth in a longitudinal direction of the container; and a base section, wherein the wall section merges into the base section and the container is formed in one piece, the base section comprising:

an injection point located in an interior region of the base section;

a central region which surrounds the injection point in a radial direction with respect to the longitudinal direction;

a plurality of curved outer ridges which extend from the central region to the wall section, and have a non-zero curvature continuously therebetween, said curved outer ridges each having a point of inflection, wherein a portion of each curved outer ridge between said central region and said point of inflection comprises a continuously changing curvature; and a plurality of depressed regions which extend from the central region to the wall section and which are disposed between ones of said plurality of curved outer ridges, each of said depressed regions having a constant radius of curvature in at least one respective radial direction of the container.

2. The container according to claim 1, wherein the base section is designed with point symmetry with respect to the injection point.

3. The container according to claim 1, wherein the central region, with respect to a geometric centre point of the base section, has a radius of less than 15 mm.

4. The container according to claim 1, wherein the curved outer ridges each have a first curved region with a substantially constant first radius of curvature (R1).

5. The container according to claim 4, wherein the first curved region is adjoined on the radially outer side by a second curved region, wherein this second curved region likewise has a substantially constant second radius of curvature (R2).

6. The container according to claim 5, wherein the first curved region and the second curved region are curved in a same direction.

7. The container according to claim 5, wherein the second radius of curvature (R2) of the second curved region is greater than the first radius of curvature (R1) of the first curved region.

8. The container according to claim 1, wherein the base section is a free-formed base section.

9. The container according to claim 1, wherein the container has a liquid capacity of at least 250 ml.

* * * * *